United States Patent [19]

von den Stemmen et al.

[11] 4,083,424

[45] Apr. 11, 1978

[54] PUSH-BUTTON COMBINATION LOCK FOR VEHICLES

[75] Inventors: Alfons von den Stemmen, Agoura; John R. Swartz, Woodland Hills, both of Calif.

[73] Assignee: Freight Guard Industries, Westlake Village, Calif.

[21] Appl. No.: 766,943

[22] Filed: Feb. 9, 1977

[51] Int. Cl.[2] ..... E05B 65/16

[52] U.S. Cl. ..... 180/114; 70/278; 361/172

[58] Field of Search ..... 180/114, 112; 361/172; 70/278, 282

[56] References Cited

U.S. PATENT DOCUMENTS

| | | | |
|---|---|---|---|
| 3,641,396 | 2/1972 | Kossen | 70/278 |
| 3,754,164 | 8/1973 | Zorzy | 361/172 |
| 4,013,930 | 3/1977 | Geller | 70/278 |

*Primary Examiner*—Joseph F. Peters, Jr.
*Assistant Examiner*—Donn McGiehan
*Attorney, Agent, or Firm*—Ralph B. Pastoriza

[57] ABSTRACT

A push-button keyboard is located on the dashboard of a truck for unlocking a rear access door to rear cargo space in the truck. Selected ones of the keys are sequentially operated in accord with a given combination generating a signal which throws a lock bolt as by means of a solenoid. A first timer prevents operation of the lock unless the combination keys are operated within a first given time interval. A second timer automatically releases the solenoid operated lock bolt after a second given interval of time has elapsed to relock the access door in the event it has not been opened. The signal to the solenoid operated bolt itself is frequency coded to inhibit introduction of unauthorized signals in an unauthorized attempt to operate the lock.

6 Claims, 5 Drawing Figures

PUSH-BUTTON COMBINATION LOCK FOR VEHICLES

This invention relates generally to electronic push-button type combination locks and more particularly to such a lock specifically designed for vehicle doors such as provided on the rear of truck vans and the like.

BACKGROUND OF THE INVENTION

Electrically operated locks are well known in the art. For example, U.S. Pat. No. 848,256 issued Mar. 26, 1907 discloses such an electrical lock for a railway truck while U.S. Pat. No. 1,283,845 issued Nov. 5, 1918 shows a similar lock employing push-buttons for a safe.

Considerably more recently, U.S. Pat. No. 3,691,396 issued Sept. 12, 1972; U.S. Pat. No. 3,751,718 issued Aug. 7, 1973 and U.S. Pat. No. 3,831,065 issued Aug. 20, 1974 relate to electronic push-button combination locks employing solid state circuitry.

All of these locks operate essentially on the principle of actuating selected ones of keys on a keyboard in a given sequence to generate an electrical signal which in turn will throw a solenoid actuated bolt to unlock a door. Many of these known circuits further include means for preventing generation of the unlocking signal in the event a wrong key is punched as well as appropriate resetting means for locking the door.

In the specific case of trucks hauling trailers or of the van type in which access to cargo space in the truck is by way of a rear upwardly sliding door or equivalent access door, such combination push-button type electric locks are very useful. Thus, the operating keyboard can be located on the dashboard of the truck and the driver when he wishes to gain access to the rear need only punch out the appropriate combination and then go to the rear of the truck and open the door. On the other hand, certain problems can arise with such an arrangement when utilized on vehicles. For example, a driver may punch out the correct combination while in the cab and then for some reason or other be delayed in walking around to the rear to open the door. In the event such delay is for an unusually long period of time, as might occur should the truck driver have a heart attack, the door lock would be opened and unauthorized personnel could then gain access.

In other instances, it is conceivable that an unauthorized person could simply by trial and error attempt to open the rear door by arbitrarily pushing certain keys on the keyboard. Finally, where the solenoid operated bolt locking mechanism itself is located adjacent the door at the rear of the vehicle, while the keyboard itself is located on the dashboard, wire connections from the keyboard to the lock are necessary and it is possible that an unauthorized person may attempt to tap into the wires leading to the locking mechanism and generate a signal for operating the same.

BRIEF DESCRIPTION OF THE PRESENT INVENTION

With all of the foregoing in mind, the present invention contemplates an improved push-button electric combination lock for vehicles, particularly trucks including certain additional features to frustrate unauthorized entry and help overcome some of the aforementioned problems.

More particularly, the lock of the present invention includes a plurality of manually operable keys, a signal responsive lock means, and circuit means connected to given ones of the keys responsive to sequential operation thereof to provide a first signal. A timer means is provided responsive to generation of the first signal to initiate a given time interval during which a second signal is passed from the circuit means to the lock means to open the lock means. The second signal is automatically terminated by the timer means at the end of the given time interval so that the door on a truck, for example, will relock in the event it is not opened within the given time interval.

With the foregoing arrangement, if a truck driver does not leave his cab and go to the rear of the truck to open the door within the set time interval after the combination lock has been operated, the access door will relock and thereby prevent unauthorized entry.

In accord with another feature, there is provided an additional timing means which will prevent operation of the lock unless the particular combination sequence is completed within a given time interval. This latter time interval may be from one to four seconds so that unauthorized entry by a person simply arbitrarily pressing a sequence of buttons is frustrated except in the remote chance that the correct sequence is carried out within this latter time interval.

Still a further feature relates to the provision of the unlocking signal between the keyboard in the cab of the truck and the lock mechanism at the rear of the truck in the form of a coded frequency signal. By such an arrangement, unauthorized entry by an attempt to tap into the wire system between the keyboard and lock mechanism is frustrated unless the unauthorized person should be aware of the precise frequency of the coded signals.

BRIEF DESCRIPTION OF THE DRAWINGS

A better understanding of this invention as well as further features and advantages thereof will be had by referring to the accompanying drawings in which.

DETAILED DESCRIPTION OF THE PREFERRED EMBODIMENT

Figure 1:
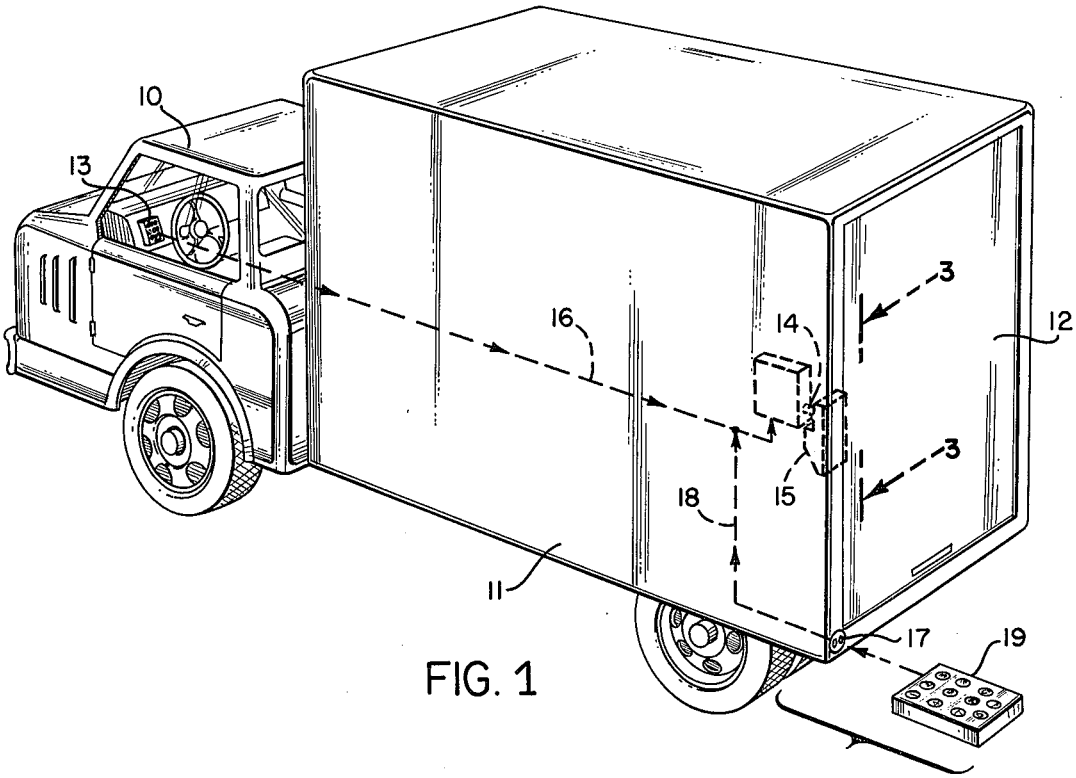
FIG. 1 is a perspective view of a typical truck having cargo space accessible through a rear door incorporating the push-button combination lock of this invention.

Referring first to FIG. 1, there is shown a truck 10 having a cargo space 11 to which access may be had through a rear overhead sliding door 12.

The combination lock of the present invention includes a housing unit arranged to be mounted in the cab of the truck 10 on the dashboard as indicated at 13. This housing unit includes a keyboard having a plurality of keys for manual operation. Illustrated in phantom lines adjacent the rear door 12 is a locking mechanism 14 including a spring biased solenoid operated lock bolt cooperating with a latch plate 15 permanently secured to an inside marginal edge of the door 12.

Appropriate wire connections from the housing unit 13 in the truck cab to the lock mechanism 14 is indicated by the dashed line 16. The arrangement is such that when a proper combination is punched onto the keyboard in the housing unit 13 in the cab of the truck, an appropriate unlocking signal will be passed on the wire means 16 to the locking mechanism 14 to retract the bolt and permit the door 12 to be opened.

In accord with a feature of this invention, there is provided a jack 17 exteriorally exposed and connected into the wire means 16 as by branch leads 18 again indicated in phantom lines. The jack 17 is arranged to receive output leads from a further housing unit 19 incorporating a keyboard identical to that in the housing unit 13.

With the foregoing arrangement, an authorized agent at a truck stop can open the rear door 12 by simply plugging in his housing unit 19 and punching the correct combination. This latter feature would be useful in the event that the cargo in the truck was to be maintained secret even from the truck driver himself in which event the truck driver would not be given the combination but an appropriate authorized agent at a truck stop would have the combination and thus could gain access to the cargo space.

Figure 2:
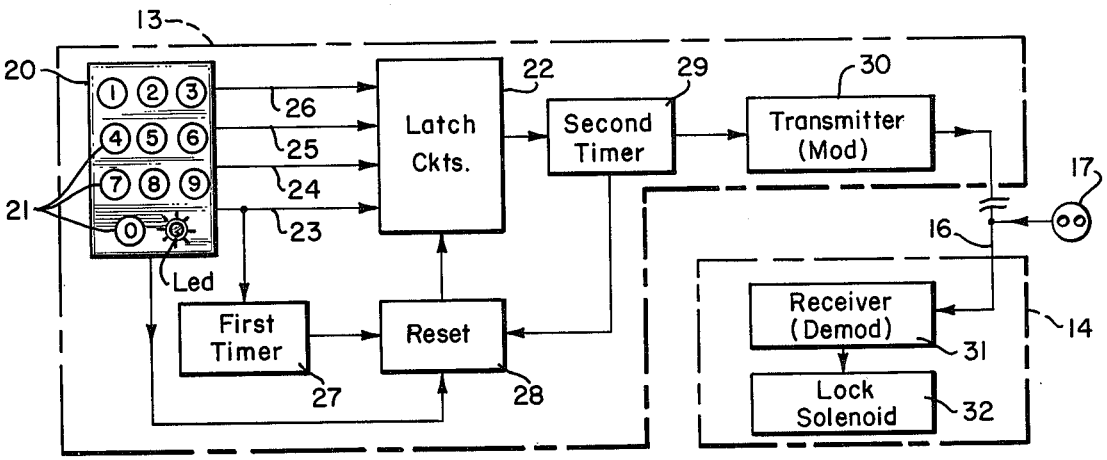
FIG. 2 is a basic block diagram of the push-button combination lock incorporated in the truck of FIG. 1.

Referring now to FIG. 2, the basic components making up the combination lock are shown. Thus, the housing unit 13 includes all of the components enclosed within the dash line 13 of FIG. 2. As mentioned, these components include a keyboard 20 having the referred to plurality of keys 21 for manual operation. These keys may be numbered with the digits 1 through 9 and 0. Also illustrated is a light emitting diode LED mounted on the keyboard, the purpose of which will become evident as the description proceeds.

A latch circuit means indicated by the block 22 is connected to the keyboard through leads 23, 24, 25 and 26, these electrical leads connecting to given ones of the keys 21 defining the combination for operation of the lock.

A first timer indicated by the block 27 is connected to the first lead 23 in the keyboard and is responsive to operation of the first of the given ones of the keys for initiating a first given time interval. A reset means 28 connects between this first timer 27 and the latch circuit means 22 and functions to block the generation of a first signal from the latch circuits 22 only in the event the first time interval terminates prior to operation of the last of the given ones of the keys; that is, the key providing a signal on the lead 26 to the latch circuit.

By provision of the first timer 27, and by setting the timer to a short given time interval of, for example, 1 to 4 seconds, it will be evident that in order to provide the first signal from the latch circuit means 22 the sequential operation of the correct push-buttons must be completed within this time interval.

A second timer is shown at 29 connected between the latch circuit means 22 and the reset means 28. This second timer is responsive to the first signal for initiating a second given time interval of greater duration than the first given time interval. Essentially, the second timer 29 provides a second signal only during the duration of the second time interval, this second signal being passed to a transmitter 30. When the second given time interval terminates, the reset circuit 28 will reset the latch circuits and thus terminate the second signal to the transmitter 30.

Transmitter 30 essentially includes a modulator which will provide an a.c. signal of given frequency along the wire means 16 connecting to the locking mechanism enclosed within the dash block 14. This locking mechanism as described is shown in FIG. 1 at the rear portion of the truck.

Locking circuit 14 essentially includes a receiver comprised of a demodulating circuit for providing an output d.c. signal only if the signal on the wire means 16 is of the correct given frequency. This latter output d.c. signal then operates a spring biased solenoid operated lock bolt 32.

Figure 3:
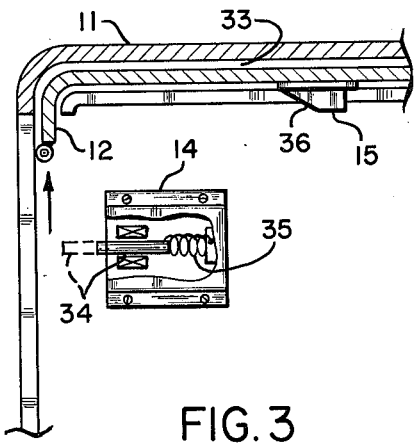
FIG. 3 is a fragmentary cross section of the locking mechanism in the rear portion of the truck looking in the direction of the arrows 3—3 showing the access door in open position.

Referring to the detailed fragmentary cross section of FIG. 3, the cargo space 11 includes upper guide channels 33 for the upwardly sliding rear access door 12. Also shown in FIG. 3 is the latch plate 15 secured to the marginal edge of the door 12. The solenoid operated bolt itself is shown at 34 together with a biasing spring 35 normally urging the bolt outwardly; that is, to its locking position.

It will now be understood that when the lock solenoid is energized, the bolt 34 will be retracted against the bias of the spring 35 for a given time interval determined by the second timer 29 of FIG. 2. During this time interval, the truck driver can descend from his cab and walk to the rear of the truck and then slide the rear access door 12 open, the retracted bolt being free of the latch plate 15. At the end of the second time interval, the solenoid will be de-energized and permit the spring 35 to return the bolt 34 to its extended locked position. However, the door 12 will have been opened so that access is had to the cargo space.

Figure 4:
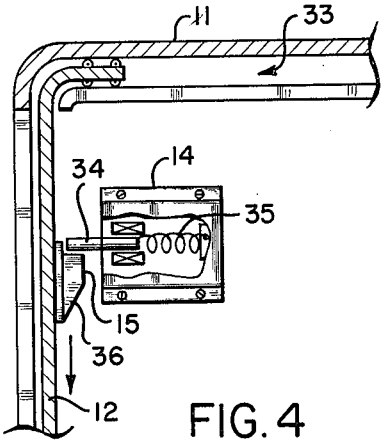
FIG. 4 is a view similar to FIG. 3 but showing the access door in closed locked position.

Referring now to FIG. 4, when cargo has been removed or inserted into the space and it is desired to relock the door 12 it is simply slid downwardly until the latch plate engages the extended bolt 34. As clearly shown in both FIGS. 3 and 4, this latch plate includes a sloping cam surface 36 which will engage the end of the bolt 34 in downward travel of the door to mechanically retract the bolt 34 against the bias of the spring 35. When the latch passes the end of the bolt, it will then snap out by the spring 35 to overlie the end of the latch plate 15 and thus secure the door in locked position.

The rear access door 12 cannot then again be opened until the correct combination is punched on the keyboard 20 of FIG. 2.

Figure 5:
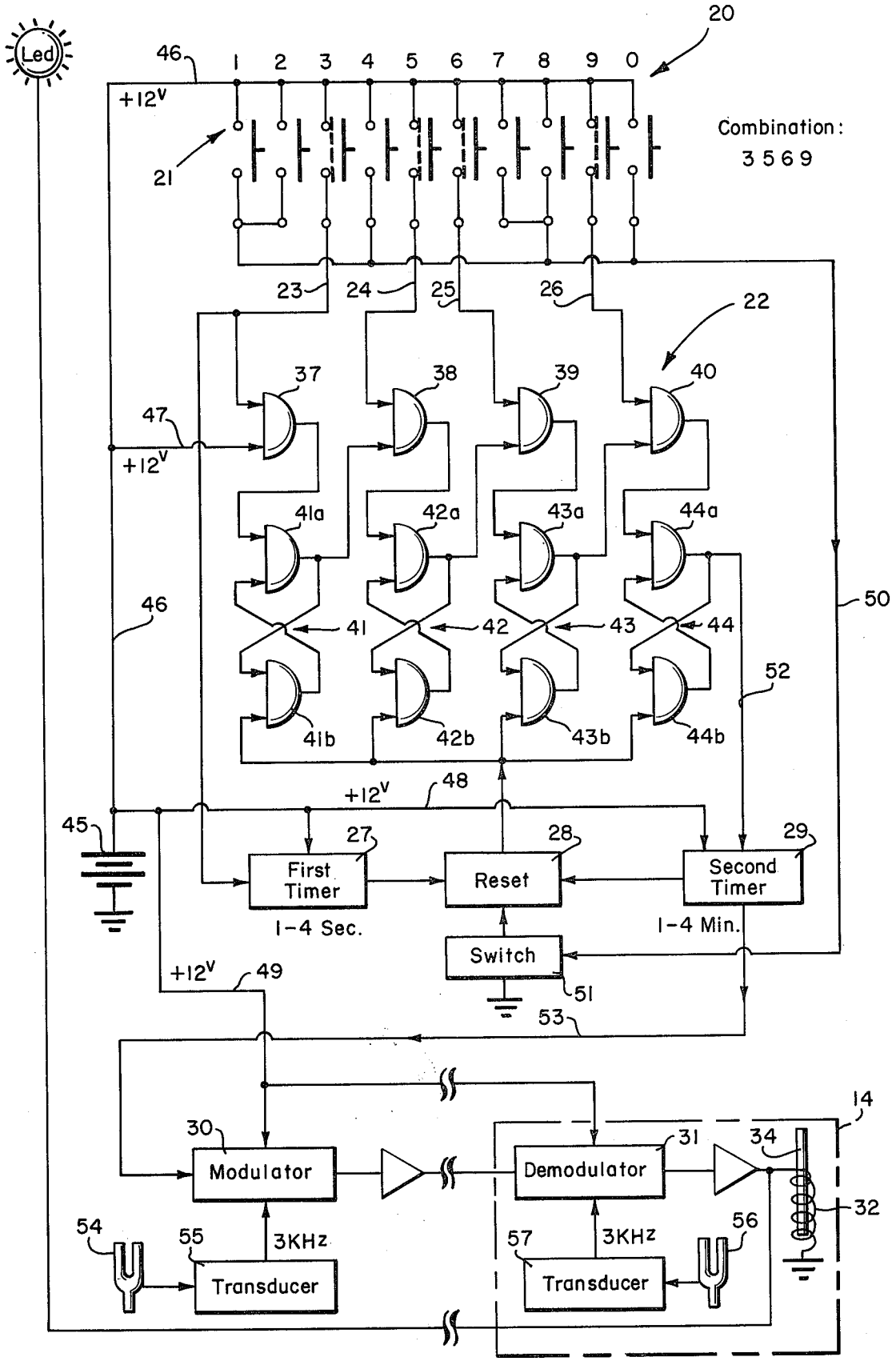
FIG. 5 is a schematic electrical diagram partly in block form illustrating one type of circuit for the lock of this invention.

Referring now to FIG. 5, various components and blocks already described in conjunction with FIGS. 1 through 4 are identified by the same numerals, the entire circuit being similar to the block diagram of FIG. 2 except to the extent that the push-button contacts themselves as well as the latch circuit means, transmitter and receiver portions are shown in greater detail.

Thus, referring first to the upper central portion of FIG. 5, the particular latch circuit means 22 may comprise any type of well known latch mechanism such as illustrated in the heretofore referred to prior patents. In this respect, the particular latch circuit per se is not in and of itself our invention but rather the combination of the latch circuit with certain of the other components disclosed. In other words, while one type of solid state latch circuit 22 is shown in FIG. 5, any equivalent latching type circuit even those of the mechanical relay type could be used.

In the particular latch circuit disclosed, the same includes a plurality of gates 37, 38, 39 and 40, having first inputs connected to the leads 23, 24, 25 and 26 respectively, from those push-buttons to be sequentially operated in accord with the specific combination. In the example shown in FIG. 5, the correct combination of push-buttons and the proper sequence for operating the same is 3569. Thus, the leads 23 through 26 are initially wired to connect to these specifically numbered push-buttons, thereby setting the combination. If a different combination were desired, the four leads 23 through 26 would simply be connected to other key button terminals.

Appropriate latch gates for the gates 37 through 40 are indicated generally at 41, 42, 43 and 44 each of these latch circuits including pairs of gates 41*a*, 41*b*; 42*a*, 42*b*; 43*a*, 43*b*; and 44*a*, 44*b*.

Referring to the lower left portion of FIG. 5, there is shown a source of electrical energy in the form of a battery 45 which would constitute the truck battery. Normally, this battery would be a 12-volt d.c. source, positive 12-volts being provided on a power line 46 and connecting to the upper terminals of the various push-buttons 21 as shown in FIG. 5. The 12-volt power line also includes a branch lead 47 connecting into the second terminal of the first gate 37 only. 12-volt power is also provided through branch lead 48 in the central portion of FIG. 5 to the first timer 27 and second timer 29. In addition branch lead 49 from the power line 46 provides 12-volt energy to the transmitter modulator 30 and receiver demodulator 31.

Finally, there is provided a lead 50 shown to the right in FIG. 5 connecting the lower terminals of all of the keys not constituting the keys of the combination together and to a switch 51 connecting into and constituting part of the reset means 28.

As will become clearer when the operation is described, if the correct combination of keys is operated, there will be provided a first signal on an output line 52 from the latching circuit 22 passing to the second timer 29 and initiating the second given time interval heretofore described. During this second time interval, a 12-volt signal is passed through the second timer 29 from the lead 48 to an output lead 53 to modulator 30. This signal is modulated at an audio frequency as by means of a tuning fork 54 and transducer 55 connecting to the modulator 30.

As described heretofore, this given frequency signal is then passed through the wire means 16 of FIG. 1 to the locking mechanism 14 which, as shown in FIG. 5, includes the demodulator 31. Actual demodulation requires an identical frequency provided by a second tuning fork 56 and transducer 57. The final output signal passes to the spring biased solenoid operated lock bolt 32 to retract the bolt 34.

By utilizing a given frequency defined by the tuning forks 54 and 56, any attempts for an unauthorized person to inject a signal into the wire means 16 between the keyboard and lock mechanism as described in FIG. 1 will be frustrated in that such signal will not operate the lock unless it happens to be of the precise frequency of the tuning forks.

OPERATION OF THE CIRCUIT OF FIG. 5

Assuming that the circuit is wired for the specific combination 3569 as described in FIG. 5, depression of the first key of the combination number 3 will place positive 12 volts from the line 46 on the lead 23 to the first input of the gate 37. Since this gate is already provided with 12 volts at its second input by the branch lead 47, it is opened to pass the signal to the first input of the latch gate 41*a*. Essentially, gate 37 may comprise a simple coincidence circuit. At the same time that the key number 3 is depressed, the 12 volts on the line 23 will pass to the first timer 27 initiating a first given time interval during which this 12 volts passes through the reset circuit 28 to the lower or second input of the latching gate 41*b*. The first timer 27 will maintain 12 volts at the second input of 41*b* from the branch power line 48 and through the reset circuit 28 even though the first push-button 3 is released removing the 12 volts from the line 23. The latching gates 41*a* and 41*b* pass this 12 volts to the second input of the gate 38.

When the second button number 5 of the combination is depressed, 12 volts will be applied through lead 24 to the first input of the gate 38 giving rise to a 12 volt output into the first input of the latch gate 42*a*. The lower latch gate 42*b* has its second input supplied with 12 volts through the first timer assuming that the first time interval is still running so that again a 12 volt signal is maintained which passes to the third gate 39. When the third combination key number 6 is depressed, gate 39 will be opened to repeat the foregoing operation, the 12 volt signal again being maintained by the latch gates 43*a* and 43*b* so that finally there is provided a first output signal from the last gate 40 which is maintained by the latch gates 44*a* and 44*b* to appear on the lead 52.

The first signal on the lead 52 will terminate at the expiration of the first given time interval controlled by the timer 27. As mentioned, this time interval may be from 1 to 4 seconds so that in order to provide a first signal on the lead 52, the four buttons must be sequentially depressed in sequence within this time interval.

The first signal on the lead 52 initiates operation of the second timer 29 which will pass 12 volts from the branch lead 48 to the lead 53 for a second given time interval, this 12 volt signal on lead 53 being maintained even though the first signal on 52 no longer exists.

The d.c. output signal on lead 53 then passes to the modulator 30 and is frequency modulated by the tuning fork 54 and transducer 55 to pass to the demodulator 31.

Demodulator 31 demodulates the signal via the tuning fork 56 and transducer 57 to provide a d.c. output signal for energizing the solenoid operated lock bolt 32 thereby retracting the bolt 34. This second signal of given frequency is maintained for the second time interval determined by the timer 29. When this time interval terminates, a signal is passed to the reset means 28 which will remove 12 volts from the lower second inputs of the latch gates 41*b*, 42*b*, 43*b* and 44*b* thereby resetting all of the latches to their initial condition.

In the event that a key other than a correct combination key should be depressed by the operator such as one of the keys 1, 2, 4, 7, 8, or 0, 12 volts will be provided on the line 50 to close switch 51 and apply ground to the reset circuit 28 immediately to the lower second inputs of the latch gates 41*b*, 42*b*, 43*b* and 44*b* thus immediately resetting the latch circuits so that no signal will appear on the lead 52 to start operation of the second timer 29.

As fully described heretofore, once the bolt 34 is retracted by the solenoid, the operator will have the second given time interval which may be from 1 to 4 minutes to step down from his cab and open up the rear door. Thereafter, when the signal to the lock solenoid terminates, the bolt will be biased outwardly to its locked position but provided the door is open, access is still had to the interior of the truck. Closing of the door will automatically effect a locking thereof by the latch plate cam surface which automatically retracts the bolt mechanically to effect locking as described in conjunction with FIG. 4.

As also described heretofore, the combination lock may be operated directly from the rear of the truck by an agent or other person simply plugging in an identical housing unit indicated at 19 in FIG. 1, incorporating a keyboard and all of the components enclosed within the housing 13 of FIG. 2. This jack is schematically shown by the same numeral 17 in the block diagram of FIG. 2 tapping into the wire means 16.

In order that the cab driver will be advised that he has inserted the correct combination, when the solenoid operated bolt 32 of FIG. 5 is energized, the signal therefor is passed back through the wire means 16 to the light emitting diode LED on the keyboard. Thus, whenever this light emitting diode is energized, the truck driver or agent as the case may be will be advised that the bolt is retracted and the door can be opened. When the light is extinguished, the driver will be advised that the bolt has been released so that the door can be automatically locked by simply closing the same, if the door is already closed, that the same is thoroughly locked.

From all of the foregoing, it will thus be evident that the present invention has provided a push-button combination lock particularly useful for trucks and similar vehicles wherein certain advantages accrue over the use of known types of electronic push-button locks.

We claim:

1. A push-button combination lock for a cargo truck having an entry door to the cargo space in said truck, including, in combination:

(a) a keyboard having a plurality of keys for manual operation;

(b) latch circuit means connected to said keyboard and responsive to a sequential operation of given ones of said keys for generating a first signal;

(c) a first timer connected to said keyboard responsive to operation to the first of said given ones of said keys for initiating a first given time interval;

(d) reset means connected between said first timer and said latch circuit means for blocking the generation of said first signal only in the event said first time interval terminates prior to operation of the last of said given ones of said keys;

(e) a second timer connected between said latch circuit means and said reset means responsive to said first signal for initiating a second given time interval of greater duration than said first given time interval, said second timer providing a second signal only during said second time interval, said second timer terminating said second signal at the end of said second given time interval and resetting said latch circuit means;

(f) modulating means connected to receive said second signal and transmit an a.c. signal of predetermined frequency for the duration of said second signal;

(g) demodulating means connected to demodulate said a.c. signal and provide a d.c. control signal; and (h) a spring biased solenoid operated lock bolt for said door responsive to said d.c. control signal to retract said bolt against the spring bias to unlocked position, said d.c. control signal being terminated at the end of said second given time interval such that the spring bias returns the lock bolt to its normal locked position said keyboard, latch circuit means, first timer, reset means, second timer and modulating means being packaged in a single housing for attachment to the dashboard of said truck, said demodulating means and spring biased solenoid operated lock bolt being located in the interior of said cargo space for locking and unlocking said door whereby unauthorized entry by passing a signal directly to the demodulating means and spring bias solenoid operated lock is prevented unless said signal is at precisely said predetermined frequency.

2. A push-button combination lock according to claim 1, in which said single housing is connected to said demodulating means through wire means, said wire means including a plug-in jack exteriorally disposed adjacent to the outside of said door on said truck whereby a housing unit containing a keyboard, latch circuit means, first timer, reset means, second timer and modulating means all identical to the components in said first mentioned housing unit may be plugged into said jack to unlock said door.

3. A push-button combination lock according to claim 1, in which said modulating means includes a first tuning fork and transducer means for generating said a.c. signal of predetermined frequency, said demodulating means including an identical second tuning fork of the same frequency for demodulating said a.c. signal, said first and second tuning forks being replaceable by tuning forks of different frequencies to thereby enable said predetermined frequency to be changed.

4. A push-button combination lock according to claim 1, including an indicating light on said housing connected to said spring biased solenoid operated lock bolt to be illuminated only when said lock bolt is in its unlocked position.

5. A push-button combination lock according to claim 1, in which said first time interval is adjustable from 1 to 4 seconds and said second time interval is adjustable from 1 to 4 minutes.

6. A push-button combination lock according to claim 1, in which said door includes a latch plate secured adjacent to an inside marginal edge in a position to be engaged by said lock bolt when in its normal locked position, said latch plate including a sloping cam surface positioned to mechanically engage and retract said bolt against the bias of the spring when the door is being closed so that upon complete closure, the bolt slides past the cam surface to engage the latch plate and secure the door in locked position, opening of the door only being possible by correct entry of the combination on said keyboard to retract the bolt free of said latch plate.

* * * * *